US006431698B1

(12) United States Patent
Mou et al.

(10) Patent No.: US 6,431,698 B1
(45) Date of Patent: Aug. 13, 2002

(54) APPARATUS AND METHOD FOR CONTROLLING INTERNAL PRESSURE OF INK CONTAINER

(75) Inventors: Michael Mou; Fusan Lin, both of Hsinchu; Jan-Kuan Wei, Taoyuan, all of (TW)

(73) Assignee: Microjet Technology Co., Ltd., Hsinchu (TW)

( * ) Notice: Subject to any disclaimer, the term of this patent is extended or adjusted under 35 U.S.C. 154(b) by 0 days.

(21) Appl. No.: 09/867,296

(22) Filed: May 29, 2001

(30) Foreign Application Priority Data

Oct. 16, 2000 (TW) ..... 00131760 A

(51) Int. Cl.[7] ..... B41J 2/175
(52) U.S. Cl. ..... 347/86; 347/87
(58) Field of Search ..... 347/84, 85, 86, 347/87

(56) References Cited

U.S. PATENT DOCUMENTS 5,801,737 A 9/1998 Sato et al. ..... 347/86

6,086,192 A * 7/2000 Kurata et al. ..... 347/86

OTHER PUBLICATIONS

Pending Application entitled "Ink–Jet Cartridge", Application No. 09/433,225 filed on Nov. 04, 1999.

* cited by examiner

*Primary Examiner*—Anh T. N. Vo
(74) *Attorney, Agent, or Firm*—Wei Wei Jeang; Munsch Hardt Kopf & Harr, P.C.

(57) ABSTRACT

An apparatus for controlling an internal negative pressure of an ink container used in an ink-jet printing apparatus is disclosed. The apparatus includes a hollow tube located in an interior of the ink container, and a containing member connected to the hollow tube for containing therein an ink of the container to prevent an atmospheric air from entering the interior of the ink container while the ink container is placed upside down. Thus, upon the ink container is black to the normal placement and in the working status, the ink will not leak from the ink-jet head.

13 Claims, 5 Drawing Sheets

APPARATUS AND METHOD FOR CONTROLLING INTERNAL PRESSURE OF INK CONTAINER

FIELD OF THE INVENTION

The present invention relates to an apparatus for controlling the internal negative pressure of an ink container, especially for maintaining the internal negative pressure of an ink container to prevent ink leaking.

BACKGROUND OF THE INVENTION

Among the typical printers, the ink-jet printer is a popular product owing to its properties of high speed, quiet operation, and high printing quality. Furthermore, the corresponding accessory products of the ink-jet printer are also developed continuously.

The ink container is an important expendable product for the ink-jet printer used to contain the printing ink. As an example of such an ink container, it has been disclosed in U.S. Pat. No. 5,801,737. In this example, an ink container includes an ink storing portion for storing ink, an ink supplying portion for supplying ink to a recording head portion, an air vent for taking the atmospheric air into the ink container, and a hollow tube. One end of the hollow tube opens to the atmosphere at the air vent, above the liquid level of the stored ink, and the other end of that opens within the ink container adjacent to the bottom portion of the ink container.

According to another prior art, U.S. application Ser. No. 09/433,225 Ink-jet Cartridge, the ink container is usually equipped with a curved hollow steel tube having a small-bore to form an apparatus for controlling the internal negative pressure. As shown in FIG. 1, the ink container includes an ink chamber 10 having ink 2 inside and an ink-jet head 3 located at the lower position of the ink chamber 10. At the primary stage, the ink chamber 10 has the ink 2 inside and a negative pressure is formed at the upper space 11 of the ink chamber 10. While a driving signal is delivered from the ink-jet printer (not shown) to the ink-jet head 3 of the ink container 1, the ink 2 will be jetted out from the ink-jet head 3. The apparatus for controlling the internal negative pressure includes a curved hollow steel tube 20 having a first opening end 21 in communication with the external atmospheric air, and a second opening end 22 with a small-bore located in the ink chamber 10. When the ink container 1 is placed normally, the negative pressure in the space 11 can be maintained owing to the pressure of the ink 2 acting on the second opening end 22 of the curved hollow steel tube 20. Therefore, the defect that the ink 2 leaks from the ink-jet head 3 when the ink-jet printer is not on working status can be avoided according to the formation of certain negative pressure in the space 11.

However, once the ink container 1 is placed upside down as shown in FIG. 2, the external atmospheric air will enter the internal space 12 of the ink chamber 10 through the curved hollow steel tube 20 due to the pressure of the ink 2 acting on the second opening end 22 of the curved hollow steel tube 20 loses. Therefore, the pressure of the internal space 12 increases. Thus, once the ink container is returned to the normal placement as shown in FIG. 1, an ink leaking situation will happen because the pressure of the internal space 11 increases. This ink leaking situation further affects the printing quality of the ink-jet printer.

It is therefore tried by the applicant to deal with the above situation encountered in the prior art.

SUMMARY OF THE INVENTION

It is therefore an object of the present invention to propose an apparatus for controlling the internal negative pressure of the ink container to maintain the internal negative pressure while the ink container is placed upside down.

It is therefore another object of the present invention to propose a method for controlling the internal negative pressure of the ink container to maintain the internal negative pressure while the ink container is placed upside down.

It is therefore an additional object of the present invention to propose an ink container without leaking problem for the ink-jet printer to increase the printing quality.

According to the present invention, there is provided an apparatus for controlling an internal negative pressure of an ink container used in an ink-jet printing apparatus. The apparatus comprises a hollow tube located in an interior of the ink container, and a containing member connected to the hollow tube for containing therein an ink of the container to prevent an atmospheric air from entering the interior of the ink container, wherein the containing member is made of a material which has a higher adhesive wetting property for the ink than the hollow tube.

Preferably, the hollow tube has two opening ends, wherein a first opening end thereof is in communication with external atmospheric air, and a second opening end therein is located near an internal lower part of the ink container for contacting with the ink.

Certainly, the hollow tube can be shrunk in diameter at the second opening end. The hollow tube can be made of a steel. The hollow tube can be curved. The curved shape is preferably L-shaped.

Preferably, the containing member is sleeved on the second opening end of the hollow tube for keeping therein a portion of the ink inside the containing member. The portion of the ink is formed in a segment inside the containing member because of a capillarity of the ink on an internal wall of the containing member.

Certainly, the material having the higher adhesive wetting property can be selected from a group consisting of polyolefin, silicone, polyethylene and rubber.

According to another aspect of the present invention, there is provided a method for controlling an internal pressure of an ink container. The method comprises providing a medium for venting air in an interior of the ink container, and connecting a containing member to the medium for containing therein an ink of the container to maintain the internal negative pressure of the ink container from increasing, i.e. the pressure is decreasing.

Certainly, the medium can be a hollow tube.

Preferably, the containing member keeps therein a portion of the ink inside the containing member to prevent an atmospheric air from entering the interior of the ink container while the ink container is placed upside down.

According to additional aspect of the present invention, there is provided an ink-jet printing apparatus comprising a printing head and a detachable ink container having a hollow tube located in an interior of the ink container and a containing member connected to the hollow tube for containing therein an ink of the container to maintain an internal negative pressure of the ink container from increasing.

The present invention may best be understood through the following description with reference to the accompanying drawings, in which:

DETAILED DESCRIPTION OF THE PREFERRED EMBODIMENT

Figure 1:
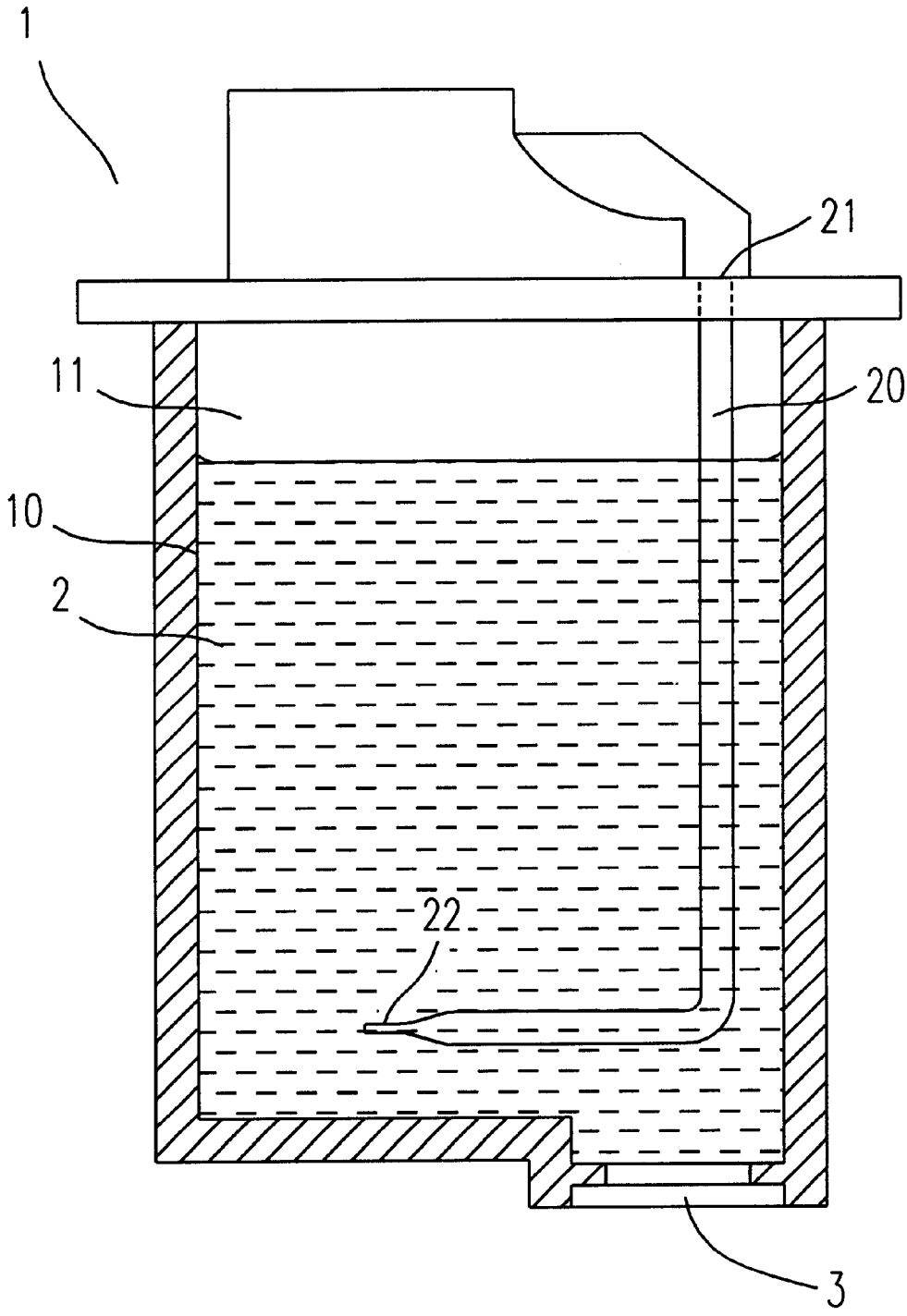
Fig. 1(PRIOR ART)
FIG. 1 is a lateral sectional view of an ink container according to the prior art.
Figure 2:
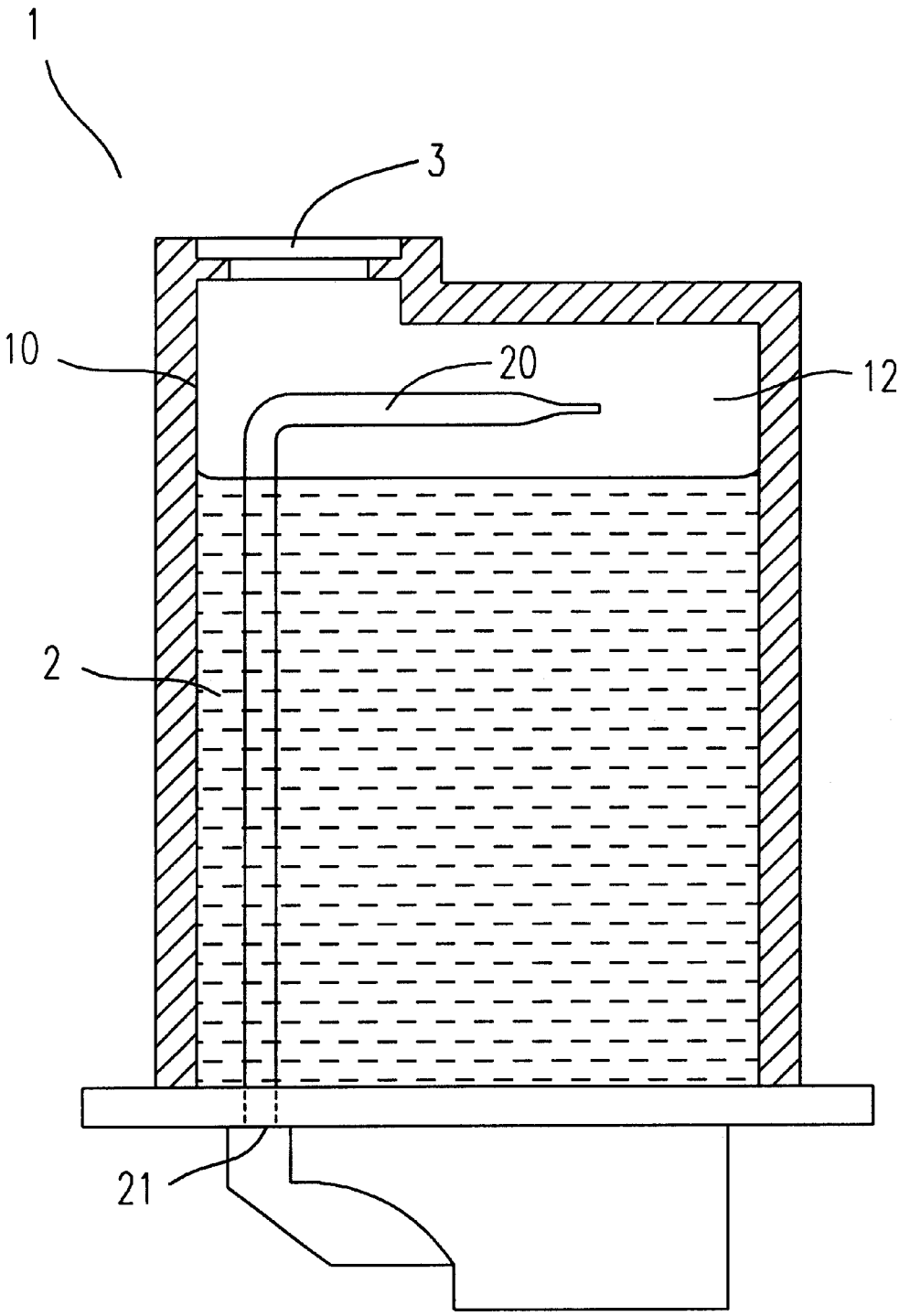
Fig. 2(PRIOR ART)
FIG. 2 is a lateral sectional view illustrating the ink container in FIG. 1 placed upside down.
Figure 3:
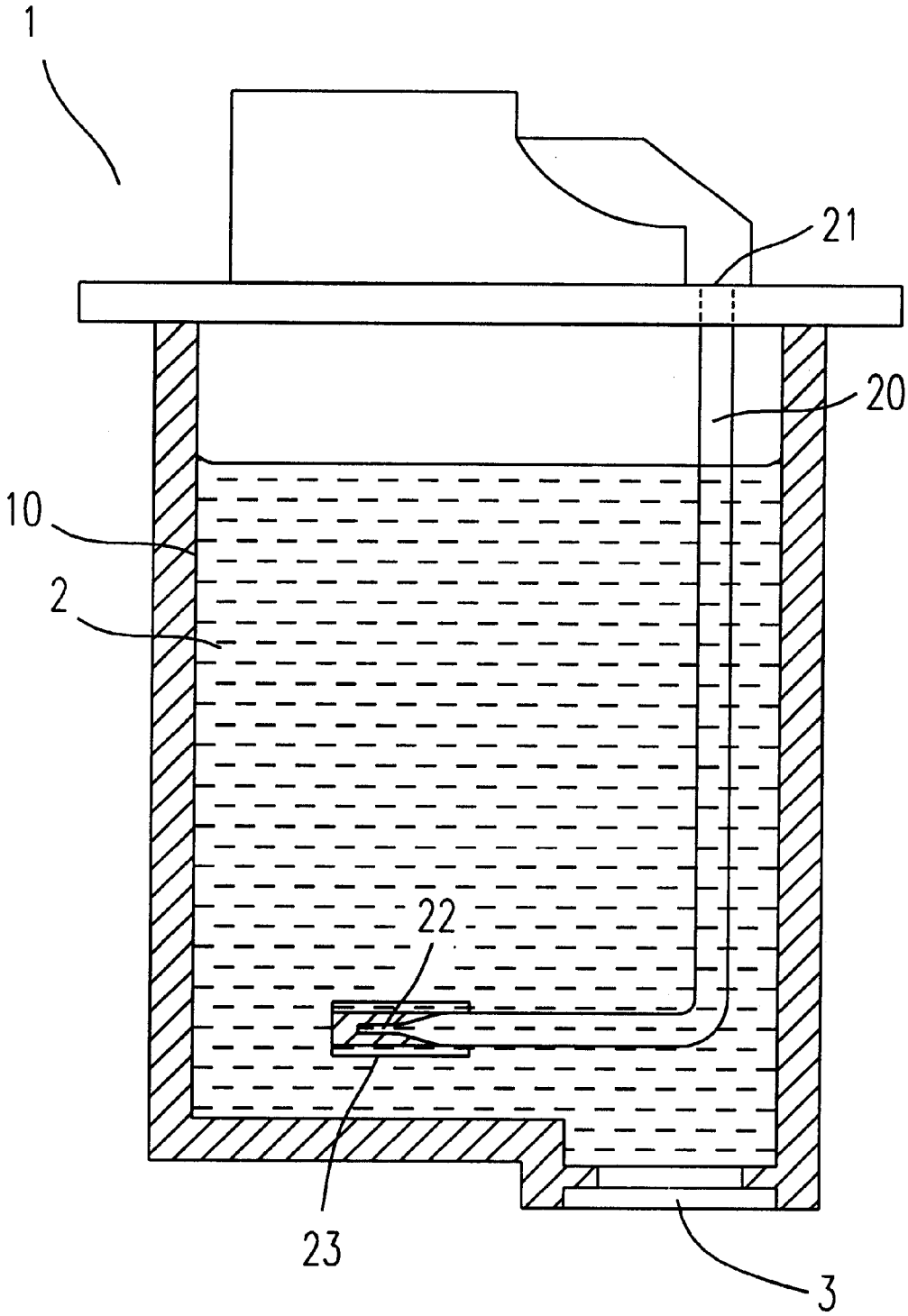
FIG. 3 is a lateral sectional view of an apparatus for controlling internal negative pressure of an ink container according to the present invention.

FIG. 3 is a lateral sectional view of an apparatus for controlling internal negative pressure of an ink container according to the present invention. The apparatus includes a curved hollow steel tube 20 and a containing member 23. The material of the containing member 23 has high adhesive wetting property for the ink 2, such as a plastic material. The plastic material includes polyolefin (P.O.F.), silicone, polyethylene, rubber, etc. When a material has a higher adhesive wetting property for a fluid, it is more difficult to remove the fluid from the surface of the material. The curved hollow steel tube 20 is located at the internal portion of the ink chamber 10 of the ink container 1. A first end 21 of the curved hollow steel tube 20 is connected to an air-entering vent of the ink container 1 for the atmospheric air entering into the curved hollow steel tube 20. The curved hollow steel tube 20 shrunk in diameter at the second opening end is located near the bottom of the ink chamber 10. The containing member 23 has a hollow tube sleeved on the second opening end 22 of the curved hollow steel tube 20.

While the ink container 1 is placed normally as shown in FIG. 3, the negative pressure in the internal space 11 can be maintained owing to the pressure of the ink 2 acting on the second opening end 22 of the curved hollow steel tube 20. That is, the negative pressure of the internal space 11 can be maintained in a consistent condition. Under such condition, the defect that the ink 2 leaks from the ink-jet head while the ink-jet printer is not at working status can be avoided. Furthermore, the containing member 23 sleeved on the second end 22 of the curved hollow steel tube 20 substantially does not affect the negative pressure of the ink container 1.

Figure 4:
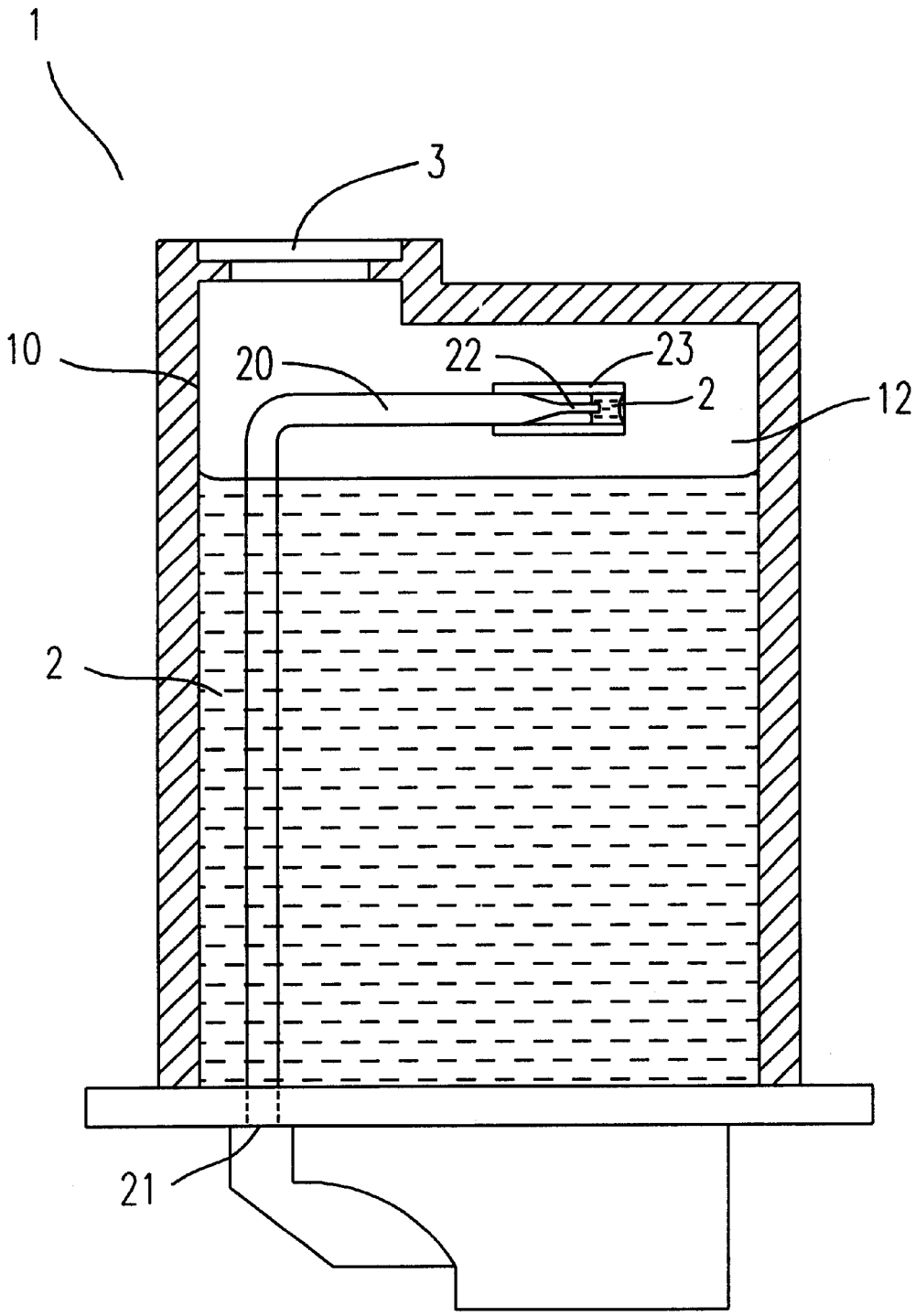
FIG. 4 is a lateral sectional view illustrating the apparatus in FIG. 3 placed upside down.
Figure 5:
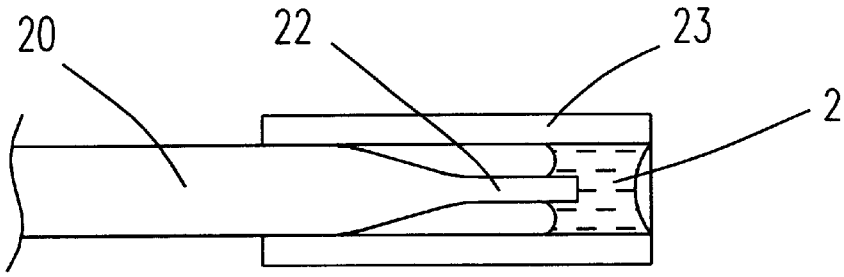
FIG. 5 is an enlarged view illustrating the portion of containing member shown in FIG. 4 according to the present invention.

FIG. 4 shows a lateral sectional view of the apparatus for controlling internal negative pressure of an ink container, while the ink container is placed upside down. As shown in FIG. 4, the second end 22 of the curved hollow steel tube 20 is separated from the ink 2 and is located in a space 12 when the ink container 1 is placed upside down. However, the internal wall of the containing member 23 has high adhesive wetting property for the ink 2, thereby a portion of the ink 2 can be remained in the internal hollow portion of the containing member 23 to form a segment for sealing the end of the containing member 23 (see FIG. 5). As shown in FIG. 5, sealing the end of the containing member 23 can prevent the air pass the first opening end 21 through the curved hollow steel tube 20 from entering into the space 12, thereby maintaining the regular negative pressure. On the contrary, if the air enters into the space 12, the pressure of the space 12 is increasing, i.e. the negative pressure is decreasing. Upon the ink container 1 is black to the normal placement and in the working status, the ink 2 will leak from the ink-jet head 3. Therefore, the apparatus for controlling the internal negative pressure according to the present invention is able to maintain the internal negative pressure of the ink chamber 10 when the ink container 1 is placed upside down.

Figure 6:
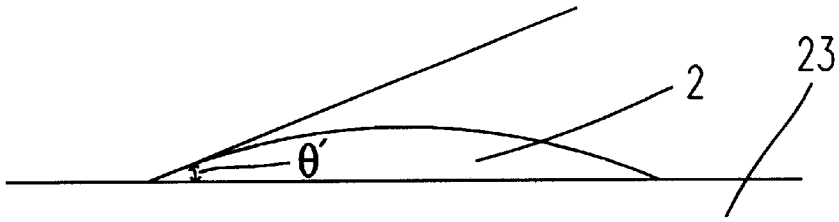
FIG. 6 is a schematic diagram illustrating the condition of the ink in contact with to the surface of the plastic material according to the present invention.
Figure 7:
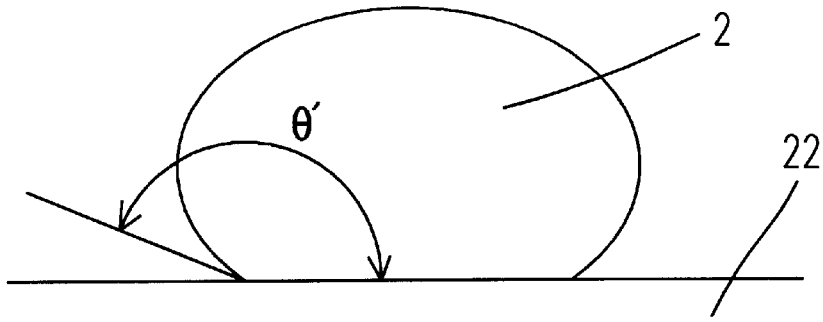
FIG. 7 is a schematic diagram illustrating the condition of the ink in contact with the surface of the stainless steel material according to the present invention.

In order to illustrate the feature of the apparatus for controlling the internal negative pressure according to the present invention, please refer to FIGS. 6 and 7. As shown in FIG. 6, the material of the containing member is plastic which has high adhesive wetting property for the ink 2. On the contrary, the stainless steel material has low adhesive wetting property for the ink 2 and the contact of the ink 2 and the surface of the stainless steel 22 is shown in FIG. 7. In contrast, the contact of the ink 2 and the surface of the plastic containing member 23 are shown in FIG. 6. Consequently, the internal hollow portion of the plastic containing member 23 can form an ink segment to prevent air passing through it while the containing member 23 is separated from the ink 2. Therefore, the disadvantage of the prior art can be improved by the apparatus for controlling the internal negative pressure according to the present invention.

Owing to the above descriptions, the ink chamber will maintain the internal negative pressure if the ink container is placed upside down upon transportation or moving. Therefore, the present invention can assure the high quality of printing effect while the ink container is placed to the operating status, for efficiently overcoming the using inconvenience and the defect according to the prior art.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An apparatus for controlling an internal negative pressure of an ink container used in an ink-jet printing apparatus, comprising:

a hollow tube located in an interior of said ink container; and a containing member sleeved around said hollow tube for containing therein a portion of ink of said ink container to prevent an atmospheric air from entering said interior of said ink container, wherein said containing member is made of a material which has a higher adhesive wetting property for said ink than said hollow tube.

2. The apparatus according to claim 1, wherein said hollow tube has two opening ends, in which a first opening end thereof is opened to an atmospheric air, while a second opening end therein is located near an internal lower part of said ink container for contacting with said ink.

3. The apparatus according to claim 1, wherein said hollow tube is shrunk in diameter at said second opening end.

4. The apparatus according to claim 1, wherein said hollow tube is made of a steel.

5. The apparatus according to claim 1, wherein said hollow tube is curved.

6. The apparatus according to claim 5, wherein said curved is L-shaped.

7. The apparatus according to claim 1, wherein said containing member is sleeved on said second opening end of said hollow tube for keeping therein a portion of said ink inside said containing member.

8. The apparatus according to claim 7, wherein said portion of said ink is formed in a segment inside said containing member because of a capillarity of said ink on an internal wall of said containing member.

9. The apparatus according to claim 1, wherein said material having the higher adhesive wetting property is selected from a group consisting of polyolefin, silicon, polyethylene and rubber.

10. A method for controlling an internal negative pressure of an ink container, comprising:

providing a medium for venting air in an interior of said ink container; and sleeving a containing member around said medium for containing therein a portion of ink of said ink container to maintain said internal negative pressure of said ink container, wherein said containing member is made of a material which has a higher adhesive wetting property for said ink than said hollow tube.

11. The method according to claim 10, wherein said medium is a hollow tube.

12. The method according to claim 10, wherein said containing member keeps therein a portion of said ink inside said containing member to prevent an atmospheric air from entering said interior of said ink container while said ink container is placed upside down.

13. An ink-jet printing apparatus, comprising:

a printing head; and a detachable ink container having a hollow tube located in an interior of said ink container, and a containing member sleeved around said hollow tube for containing therein a portion of ink of said ink container to maintain an internal negative pressure of said ink container, wherein said containing member is made of a material which has a higher adhesive wetting property for said ink than said hollow tube.

* * * * *